United States Patent [19]

Wilson

[11] Patent Number: 5,031,426

[45] Date of Patent: Jul. 16, 1991

[54] WATER INLET NOZZLE

[75] Inventor: Steven R. Wilson, Webster City, Iowa

[73] Assignee: White Consolidated Industries, Inc., Cleveland, Ohio

[21] Appl. No.: 480,222

[22] Filed: Feb. 15, 1990

[51] Int. Cl.[5] ..... D06F 39/08; B05B 1/28

[52] U.S. Cl. ..... 68/207; 68/23.5; 239/593

[58] Field of Search ..... 68/207, 23.5; 239/592, 239/593, 595, 597

[56] References Cited

U.S. PATENT DOCUMENTS

| | | | |
|---|---|---|---|
| 703,651 | 7/1902 | Griffiths | 239/593 |
| 1,951,316 | 3/1934 | Allen | 239/601 |
| 2,552,398 | 5/1951 | Briggs | 68/207 |
| 2,638,112 | 5/1953 | Shelton | 68/207 |
| 3,020,741 | 2/1962 | Waldrop | 68/207 |
| 3,121,317 | 2/1964 | Toma | 68/23.5 |
| 3,566,906 | 3/1971 | Beare | 68/207 |
| 3,605,455 | 9/1971 | Olthuis | 68/207 |
| 4,141,507 | 2/1979 | Rump | 239/597 |
| 4,424,761 | 1/1984 | Thorn et al. | 239/601 |
| 4,754,622 | 9/1990 | Fanson | 68/207 |
| 4,915,258 | 4/1990 | Olson | 239/597 |

*Primary Examiner*—William A. Cuchlinski, Jr.
*Assistant Examiner*—G. Bradley Bennett
*Attorney, Agent, or Firm*—Pearne, Gordon, McCoy & Granger

[57] ABSTRACT

A water inlet nozzle is mounted to a clothes washer so that water exiting therefrom during the spray rinse cycle is directed onto a load of clothes which has circumferentially accumulated near the bottom of the wash basket during the drain and spin cycle. The water inlet nozzle has an upper member joined to a lower member which forms a dispersion chamber therebetween. The lower member includes an inclined bottom wall which tends to cause water flowing into the inlet nozzle to disperse laterally. The lower member also includes a cascade portion which is curved downwardly and has a transversely convex crown formed within its radius of curvature which induces some water to flow toward the lateral side walls of the lower member. The upper member has a curved forward wall and a front lip which is angled downwardly and rearwardly. A discharge orifice is formed between the terminal edges of the cascade portion and the front lip which is narrower near its center than it is at its edges. The front lip has a radius of curvature formed therein which is larger near the front lip's center than it is near its edges so that water exiting near the edges of the discharge orifice is directed more rearwardly than the water exiting near the center of the discharge orifice thereby forming an arcuate spray pattern. The edges of the spray pattern are directed higher upon the load of clothes in the wash basket than the center of the spray pattern which assures that the clothes are rinsed as thoroughly as practically possible during the spray rinse cycle.

15 Claims, 4 Drawing Sheets

WATER INLET NOZZLE

BACKGROUND OF THE INVENTION

1. Field of the Invention

This invention relates to a water inlet nozzle for an automatic clothes washer, and more particularly to a water inlet nozzle which provides a spray pattern in a direction which rinses clothes as thoroughly as practically possible during the spray rinse cycle.

2. Description of the Prior Art

Conventional clothes washing machines execute a series of cycles to wash clothes. The clothes to be washed and detergent are initially placed in a perforate wash basket concentrically contained within a splash tub, both being housed within an outer cabinet. A vertical axis agitator is contained within the wash basket and is mechanically responsive to a drive motor. The wash basket is filled with water to a predetermined level and the wash cycle is begun. The clothes are agitated for a length of time and then then wash water is pumped from the wash basket. As the water drains, the wash basket is spun to help remove excess water and particlulates from the clothes. As the wash basket spins centrifugal force causes the clothes to accumlate circumferentially along the sidewall near the bottom of the wash basket. A spray rinse cycle is then activated during which the interior of the wash basket is sprayed with water as it spins the clothes contained therein. This helps to remove detergent and particulates from the interior walls of the wash basket and ideally rinses the clothes as thoroughly as practically possible. A deep rinse is then conducted where the wash basket is filled to a predetermined level with rinse water and the clothes are again agitated before the final drain.

The purpose of a water inlet nozzle is to introduce water into the wash basket during the various cycles. During the initial fill cycles and during the fill operation when preparing for the deep rinse cycle the direction the water is introduced into the wash basket is of minimal concern because the objective is to fill the wash basket so the wash or rinse cycle may begin. However, during the spray rinse cycle it is advantageous to direct the spray primarily onto the clothes accumulated around the interior wall of the wash basket to assure that they are rinsed off as thoroughly as practically possible.

U.S. Pat. No. 4,754,622 issued to R. L. Fanson on July 5, 1988 discloses a water inlet device designed to compensate for varying water pressures of water supply sources. The device tends to eliminate redirected water spray, resulting from high pressures, from entering areas of the washer cabinet which are not designed for excessive water spray. This is accomplished by a unique front lip or wall of the device which directs water to different portions of the wash basket depending upon the amount of water pressure being applied. During low water pressure conditions most of the inlet water is directed downwardly and toward the wash basket wall with a portion of the inlet water being directed toward progressively lower portions of the basket wall. As the water pressure increases, more and more of the inlet water will be directed lower on the basket interior wall or away from the basket wall. At very high inlet water pressures most of the water is directed downwardly while a relatively constant amount of water will be directed against the basket interior wall.

The various inlet directions obtained by the fill nozzle of Fanson are the result of a front lip which has a portion adjacent the center that is angled downwardly and slightly rearwardly to direct the flow of water at an angle of approximately 13° toward the basket wall. The lip changes in shape so that adjacent the two side edges the surface is angled downwardly and slightly forwardly at an angle of approximately 15° so that the water flow will be directly downwardly and toward the agitator or, in effect, toward the curving side walls of the basket at points circumferentially spaced from the inlet nozzle. The resultant spray pattern is substantially arcuate with the edges being directed more downwardly and away from the wash basket wall than the center of the spray pattern.

U.S. Pat. No. 3,605,455 issued to E. G. Olthuis on Sept. 20, 1971 discloses a water inlet device which provides a gentle stream of liquid into the wash basket despite large variations of the inlet pressure. The device utilizes a cup-shaped member having a plurality of downwardly depending projectons which break up and spread out the flow of water as it discharges into the washing basket. The resulting discharge stream is gentle and thereby eliminates excess splash. One embodiment of Olthuis provides a discharge trajectory which is somewhat inclined from the vertical but no indication is made as to where the water impinges upon the interior of the wash basket.

While the aforementioned patents are concerned with varying water inlet pressures, some automatic clothes washers utilize restrictors of such a size that the rate of flow will vary only slightly over the range of pressures that can normally be expected in the water supply line. Thus, water inlet nozzles can provide a more consistent control over where inlet water will be directed within a wash basket.

SUMMARY OF THE INVENTION

Accordingly, one feature of the preferred embodiment of the present water inlet nozzle is to direct water during the spray rinse cycle primarily onto clothes which have accumulated circumferentially near the bottom of the wash basket during the drain and spin cycle thereby rinsing the clothes of detergent and other particulates as thoroughly as practically possible. This is accomplished by a unique inlet nozzle which has an inlet conduit attached to a lower member that allows water to flow from the water supply line into an expansion chamber which is formed between the lower member and an upper member. The upper member has a relatively horizontal top wall and a generally curved forward wall which directs the flow of water downwardly toward a front lip which has a terminal edge that defines part of a discharge orifice. The front lip is directed downwardly and rearwardly.

The lower member of the inlet nozzle is adapted to laterally disperse the incoming flow of water so that the water is relatively evenly distributed across the breadth of the discharge orifice when it exits therefrom. To accomplish this the lower member includes an inclined bottom wall that transforms downstream into a cascade portion which has a transversely convex surface that forms a shallow "v". The cascade portion curves downwardly and terminates with a "v" shaped terminal edge in close proximity to the terminal edge of the front lip. The discharge orifice is formed between the terminal edge of the cascade portion and the terminal edge of the front lip. The discharge orifice is narrower at its center than it is at either side. The taper of the discharge orifice from its center to either side is substantially uniform so that water exiting from the discharge orifice is generally arcuate and is directed onto the load of clothes accumulated near the bottom of the wash basket.

Another feature of the preferred embodiment of the present inlet nozzle is to direct the edes of the arcuate spray pattern higher up on the load of clothes during the spray rinse cycle than the center part of the spray pattern. This is accomplished by providing the front lip with a larger radius of curvature near its center than at its edges so that water exiting from the edges of the discharge orifice will be directed more rearwardly and consequently higher on the load of clothes than water exiting from near the center of the discharge orifice which is directed lower on the load of clothes. This spray pattern is advantageous for rinsing during the spray rinse cycle because as the load of clothes rotates the arcuate spray pattern impinges upon the clothes from top to bottom thereby urging detergent and other particulates downwardly from the clothes into the wash basket.

DETAILED DESCRIPTION OF THE PREFERRED EMBODIMENT

Figure 1:
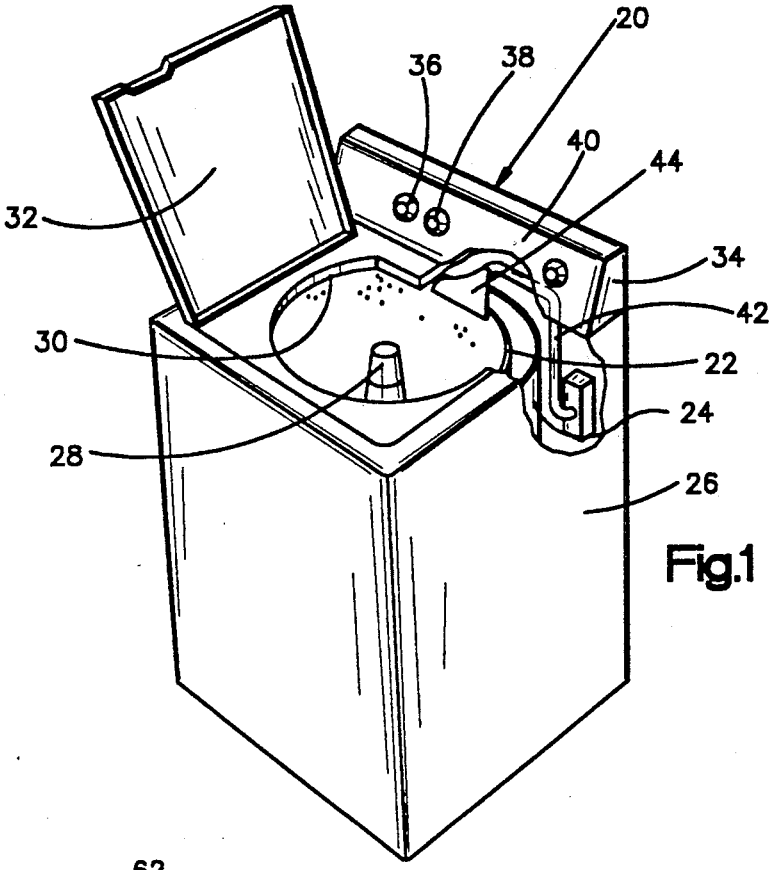
FIG. 1 is a perspective view of a clothes washing machine incorporating the preferred embodiment of the present invention.

Referring now to the drawings, and in particular to FIG. 1, there is shown a clothes washer generally referred to by reference numeral 20. The clothes washer 20 has a perforate wash basket 22 contained within a splash tub 24, both encased within an outer cabinet 26. An agitator 28 having a vertical axis is disposed within the wash basket 22 and is mechanically responsive to a drive motor, not shown. The outer cabinet 26 has an opening 30 disposed therein for gaining access to the wash basket 22. The opening 30 is coverable by a lid 32 pivotally mounted on the outer cabinet 26. A console 34 is connected to the outer cabinet 26 and has integrally connected thereto a control knob 36 and a pre-settable sequential control means 38 for use in selectively operating the clothes washer 20 through a programmed sequence of washing and rinsing cycles. Panel 40 is attached to the console 34 to protect various control circuits contained thereunder.

Figure 2:
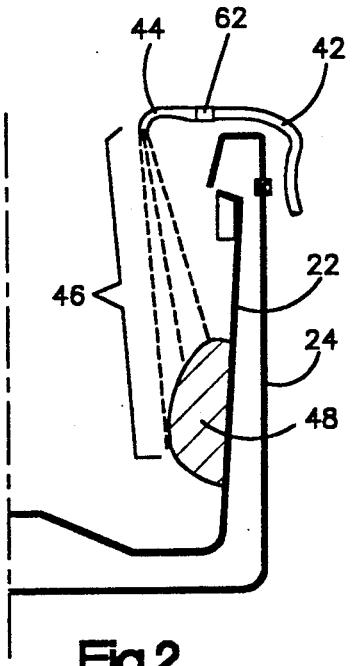
FIG. 2 is a partial side cross-sectional view of the wash basket in the washing machine of FIG. 1.
Figure 3:
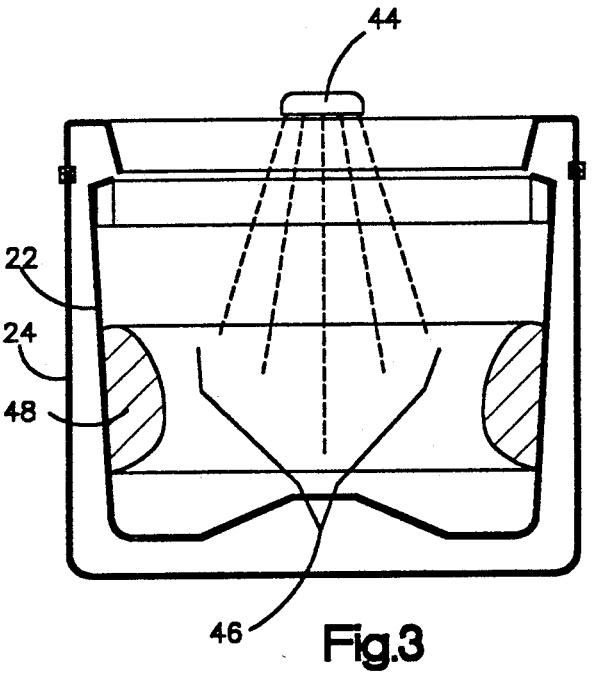
FIG. 3 is a front cross-sectional view of the wash basket of FIG. 2.

A water supply line 42 passes through the outer cabinet 26 and supplies water to the water inlet nozzle 44 of the present invention which is rigidly mounted above the wash basket 22 so that water exiting therefrom is directed into the wash basket 22. Referring now to FIGS. 2 and 3, there is shown a spray pattern of water 46 exiting the inlet nozzle 44 and being directed onto a load of clothes 48 which has accumulated circumferentially near the bottom of the wash basket 22 due to the centrifugal force generated during the drain and spin cycle. The spray pattern 46 is directed onto the load of clothes 48 during the spray rinse cycle to assure that the clothes 48 are rinsed as thoroughly as practically possible of detergent and other particulates. The direction of the spray pattern 46 is achieved by the unique and novel design of the inlet nozzle 44.

Figure 4:
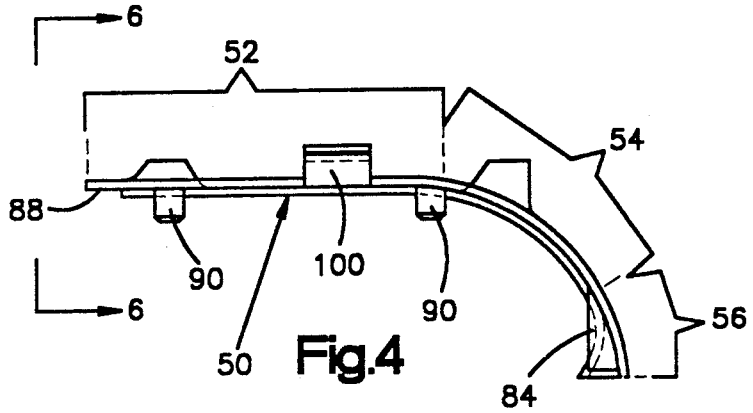
FIG. 4 is a side elevational view of the top member of the water inlet nozzle.
Figure 6:
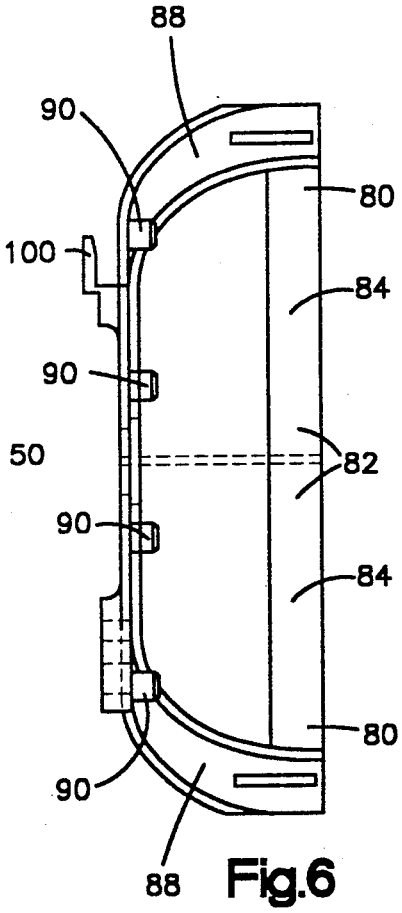
FIG. 6 is an end view of the top member taken along sectional line 6—6 of FIG. 4.
Figure 5:
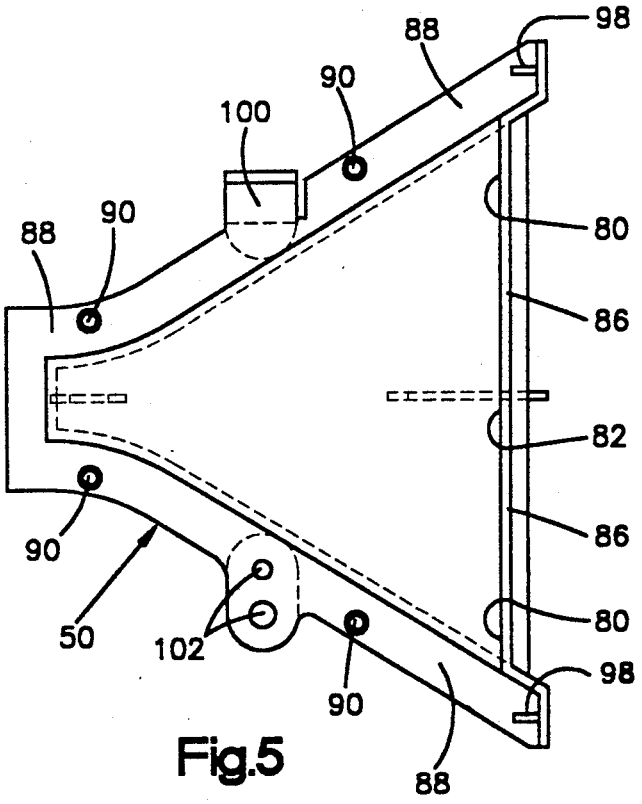
FIG. 5 is a bottom view of the top member of FIG. 4.
Figure 7:
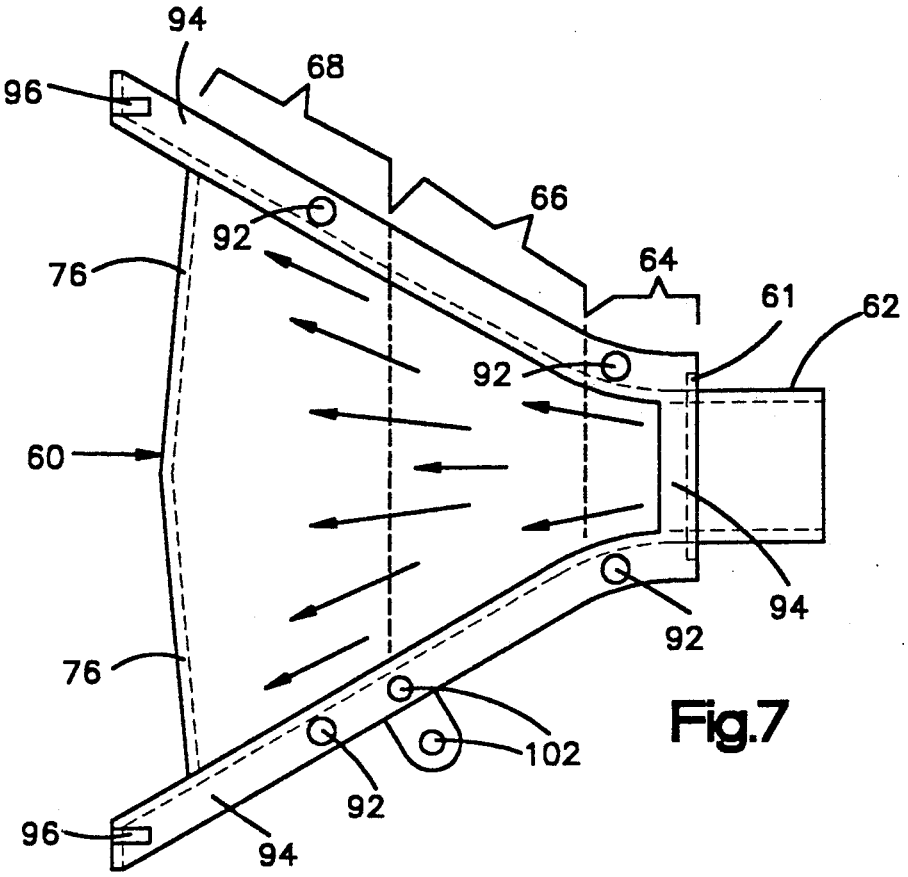
FIG. 7 is a top plan view of the bottom member of the water inlet nozzle.
Figure 8:
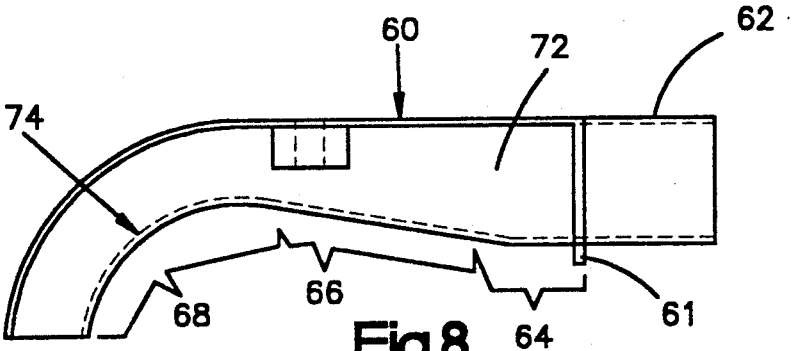
FIG. 8 is a side elevational view of the bottom member of FIG. 7.
Figure 9:
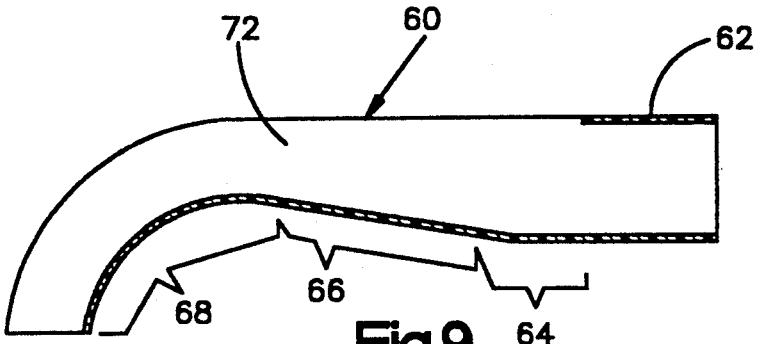
FIG. 9 is a side cross-sectional view of the bottom member of FIG. 8.
Figure 10:
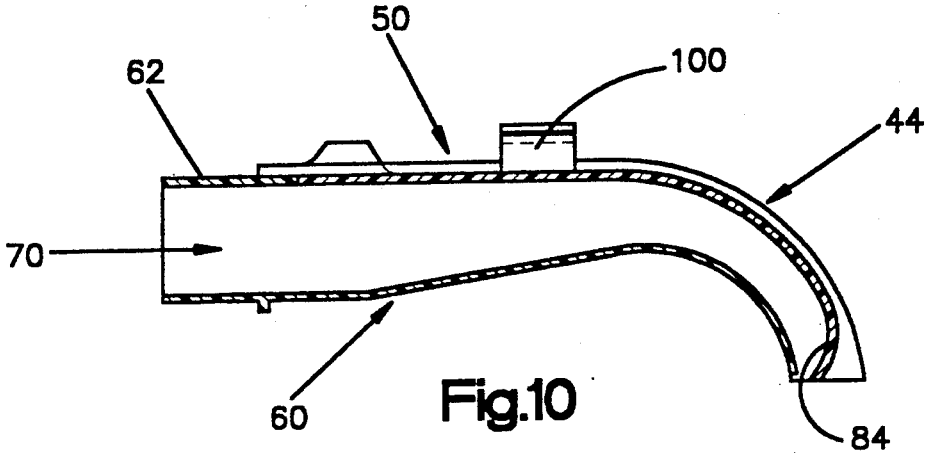
FIG. 10 is a side cross-sectional view of the top member and bottom member assembled.

As best illustrated in FIGS. 4, 5, and 6, the inlet nozzle 44 includes an upper member 50 which has a top wall 52, a forward wall 54, and a front lip 56 that generally define the contour of the upper member 50. As best illustrated in FIGS. 7, 8, and 9, the inlet nozzle 44 also includes a lower member 60 which has an inlet conduit 62, an entrance passageway 64, an inclined bottom wall 66, and a cascade portion 68. The entrance passageway 64, inclined bottom wall 66, and cascade portion 68, generally define the contour of the lower member 60. Both the upper and the lower members 50 and 60 are preferably injection molded from 22% talc filled polypropylene, although other materials could be used which are well known in the art. The upper member 50 and the lower member 60 are adapted to be securely joined together so that a dispersion chamber 70 is formed therebetween, as best shown in FIG. 10.

Referring again to FIG. 1, the inlet nozzle 44 is mounted above the wash basket 22 so that water exiting the inlet nozzle 44 is directed into the wash basket 22. The inlet nozzle 44 is mounted so that the water supply line 42 can be connected to the inlet conduit 62 of the lower member 60 in any conventional manner. The lower member 60 has a collar 61 against which the water supply line 42 may abut to help make a sealing connection, as best shown in FIG. 7. A restrictor, not shown, is used in relationship with the water supply line 42 so that the rate of flow of water into the inlet nozzle 44 varies only slightly over the range of pressures that can normally be expected in the water supply line 42. It is preferred that the inlet nozzle 44 be used with a restrictor of this type so the resultant spray pattern 46 is consistently obtained. Alternatively, the inlet nozzle 44 can be used in a clothes washer which does not have a restrictor if the incoming water pressure is at a suitable level.

During the wash cycle water is introduced into the wash basket 22 via the inlet nozzle 44. Water initially enters the dispersion chamber 70 through the inlet conduit 62. The water traveses the entrance passageway 64 and impinges upon the inclined bottom wall 66 which causes the water to disperse laterally as it moves downstream. The inclined bottom wall 66 is preferably angled approximately 10° from horizontal. The lower member 60 includes lateral side walls 72 which bound the dispersion chamber 70 and help to guide the water downstream. As the water travels downstream it traverses the cascade portion 68 which is transversely convex so that some of the water is induced toward the lateral side walls 72 as the water passes over the crown 74 of the cascade portion 68, as best shown in FIGS. 7 and 8. The cascade portion 68 forms a symmetrically shallow "v" over substantially all of its radius of curvature between the lateral side walls 72. Preferably, the inside radius of curvature near the center of the cascade portion 68 is approximately 0.875 inches. The cascade portion 68 terminates with terminal edge 76 that defines part of a discharge orifice 78, as best shown in FIG. 11.

After the water flows over the crown 74 a significant portion of it impinges upon the forward wall 54 of the upper member 50 and is redirected downwardly so that it impinges upon the front lip 56. A nominal amount of water will directly impinge upon the front lip 56 without having been redirected there by the forward wall 54. The forward wall 54 has a relatively constant transverse radius of curvature whereas the front lip 56 has a uniformly varying transverse radius of curvature. The inside radius of curvature of the forward wall 54 is preferably about 1.375 inches. The front lip 56 is curved so that at all points it is angled downwardly and rather sharply rearwardly with the distal portions 80 being angled rearwardly at a somewhat greater angle than the center portions 82 since the inner surface 84 of the front lip 56 is curved with a smaller radius of curvature at the distal portions 80 than at the center portions 82. It is preferred that the radius of curvature at the distal portions 80 is approximately 0.475 inches and at the center portions 82 the radius of curvature is approximately 0.750 inches. Preferably, the radius of curvature decreases in a uniform manner from the center portions 82 to the distal portions 80.

In order to achieve the desired spray pattern 46 the flow of water should be relatively evenly distributed laterally across the forward wall 54 and the front lip 56 when it impinges thereon. Because the water inlet conduit 62 is centrally located it is necessary to induce some water flow toward the lateral side walls 72 as the water moves downstream. The inclined bottom wall 66 and the transversely convex shape of the cascade portion 68 assures that a sufficient amount of water is induced laterally so that the water impinges the forward wall 54 and the front lip 56 in a relatively even manner and is consequently evenly distributed across the breadth of discharge orifice 78 so that water exits therefrom in the desired arcuate spray pattern 46.

Figure 11:
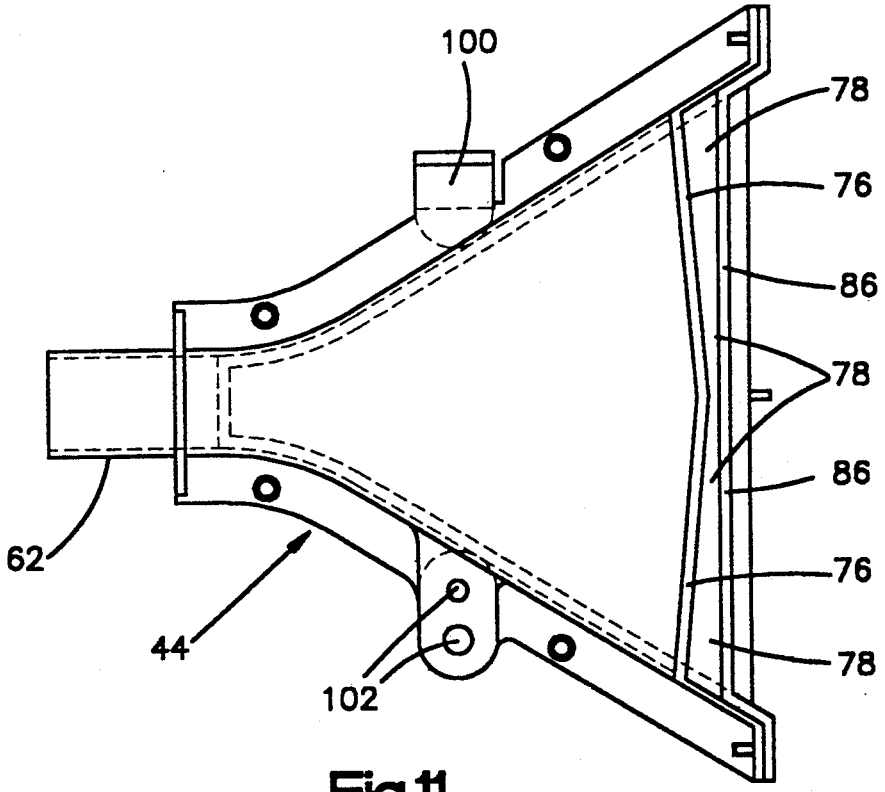
FIG. 11 is a bottom view of FIG. 10.

Referring to FIG. 11, the front lip 56 terminates with terminal edge 86 which defines part of the discharge orifice 78. The discharge orifice 78 is approximately 1/32 inch wide at the center and 5/32 inch wide at each side with the taper from the center to each side being substantially uniform. As previously stated, the change in radius of curvature from the center portions 82 to the distal portions 80 of the front lip 56 is substantially uniform. Thus, the taper of the discharge orifice 78 and the varying radius of curvature of the front lip 56 assure that water exiting the edges of the discharge orifice 78 is directed more rearwardly than water exiting nearer the center of the discharge orifice 78. Additionally, as best shown in FIG. 10, the terminal edge 86 is offset from terminal edge 76 so that the terminal edge 86 is slightly above the terminal edge 76. The offset helps to prevent the water from being directed too far rearwardly.

Referring to FIG. 2, when the water exits the inlet nozzle 44 through the discharge orifice 78 it does so in a relatively arcuate spray pattern 46 with the distal portions of the spray pattern being directed more rearwardly toward the wall of the wash basket 22 than the center portions of the spray pattern 46. Thus, the distal portions of the spray pattern 46 impinge higher upon the clothes 48 than does the central portion of the spray pattern 46. This assures the most thorough rinsing of the clothes 48 because as they rotate during the spray rinse cycle water initially impinges near the top of the clothes 48 and then progressively impinges downwardly thereby urging detergent and particulates toward the bottom of the clothes 48. The center portion of the spray pattern 46 impinges low enough on the clothes 48 to make sure that the detergent and particulates are rinsed off the clothes 48 and into the water basket 22 where the rinse water is drained.

As previously mentioned, the upper member 50 is securely joined to the lower member 60. To accomplish this, upper member 50 has a recessed flange 88 which borders the upper member 50 on three sides, as best shown in FIG. 5. The recessed flange 80 has plurality of pegs 90 perpendicularly extending therefrom which are adapted and arranged to be inserted into a corresponding plurality of apertures 92 disposed within a peripheral flange 94 which bounds two sides of the bottom member 60, as best shown in FIG. 7. The recessed flange 88 is adapted and arranged to receive the peripheral flange 94 when the pegs 90 are inserted into the apertures 92. Additionally, the peripheral flange 94 has a pair of slots 96 disposed therein and adapted to receive tabs 98, which are disposed upon the recessed flange portion 88, when the upper member 50 and the lower member 60 are joined together. When the members 50 and 60 are assembled the pegs 90 and the tabs 98 can be heat staked to secure the members 50 and 60 together. Alternatively, the members 50 and 60 could be joined together in any other conventional manner such as ultrasonic welding along the edges.

When the upper member 50 and the lower member 60 are joined the assembly is mounted to the clothes washer 20.

The upper member 50 has a mounting clip 100 disposed thereon and adapted to interact with a mounting slot of the clothes washer 20, not shown. Referring to FIGS. 5 and 7, the upper member 50 also has mounting apertures 102 formed therein which are adapted to align with corresponding mounting apertures 102 formed within the lower member 60 when the members are assembled. The mounting apertures 102 are adapted to fasten the inlet nozzle 44 securely to the clothes washer 20. Alternatively, the fill nozzle 44 could be fastened to the automatic closthes washer 20 in any other known manner provided that it is securely fastened.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What I claim is:

1. In an automatic clothes washer including a perforate wash basket for carrying a laundry load which is concentrically contained within a splash tub, both housed within an outer cabinet, the wash basket having a substantially vertical side wall, a vertical axis agitator disposed within the perforate wash basket which is mechanically responsive to a drive motor, and a water supply line, a water inlet nozzle comprising:

an upper member;

a forward wall joined to said upper member;

a front lip joined to said upper member;

a lower member joined to said upper member, and forming a dispersion chamber therebetween;

a discharge orifice formed between said upper and lower members;

an inlet conduit connected to one of said members for allowing a flow of water to pass from the water supply line into said dispersion chamber; and said lower member including means for laterally dispersing the flow of water within said dispersion chamber so that the flow of water is relatively evenly distributed laterally when it impinges upon said forward wall of said upper member, said forward wall being constructed and arranged so that the flow of water is directed downwardly thereby impinging upon said front lip of said upper member, said front lip being adapted to direct the flow of water through said discharge orifice having a center portion and edge portions so that water exiting said edge portions is directed more rearwardly toward the side wall of the wash basket than water exiting said center portion.

2. An inlet nozzle as recited in claim 1 wherein said forward wall has a constant transverse radius of curvature.

3. An inlet nozzle as recited in claim 1, wherein said front lip is angled downwardly and rearwardly toward the side wall of the wash basket, said front lip including a central portion, a first distal portion, and a second distal portion, said distal portions located one on each side of said central portion, said front lip including a terminal edge which defines part of said discharge orifice.

4. An inlet nozzle as recited in claim 3, wherein said front lip has a transverse radius of curvature which is larger near said central portion that it is near said distal portions so that the water which impinges upon said distal portions is directed more rearwardly toward the side wall of the wash basket when exiting said discharge orifice than the water which impinges upon said central portion.

5. An inlet nozzle as recited in claim 4 wherein said transverse radius of curvature uniformly decreases in size from said central portion to said distal portions.

6. An inlet nozzle as recited in claim 3, wherein said lower member includes a terminal edge which defines part of said discharge orifice, said discharge orifice being narrower near its center portion than it is near its edge portions so that a taper is formed from each of said edge portions to said center portion.

7. An inlet nozzle as recited in claim 6, wherein said tapers are uniform from said center portion to said edge portions.

8. An inlet nozzle as recited in claim 1, wherein said lateral dispersing means includes a bottom wall being upwardly inclined from said inlet conduit toward said forward wall of said upper member, said inclined bottom wall situated downstream from and contiguous to said inlet conduit.

9. An inlet nozzle as recited in claim 8, wherein said lateral dispersing means further includes a cascade portion situated downstream and contiguous to said inclined bottom wall, said cascade portion being curved downwardly and having a transversely convex crown which forms a shallow "v" for inducing water flow toward said edge portions of said discharge orifice, said cascade portion having a terminal edge which defines part of said discharge orifice.

10. An inlet nozzle as recited in claim 9, wherein said front lip is angled downwardly and rearwardly, said front lip portion including a central portion, a first distal portion, and a second distal portion, said distal portions located one on each side of said central portion, said front lip including a terminal edge which defines part of said discharge orifice.

11. An inlet nozzle as recited in claim 10, wherein said front lip portion has a transverse radius of curvature which is larger near said central portion than it is near said distal portions.

12. An inlet nozzle as recited in claim 11, wherein said transverse radius of curvature uniformly decreases in size from said central portion to said distal portions.

13. An inlet nozzle as recited in claim 8, wherein said forward wall has a constant transverse radius of curvature.

14. An inlet nozzle as recited in claim 10, wherein said discharge orifice is narrower near its center portion than it is near its edge portions so that a taper is formed from each of said edge portions to said center portion.

15. An inlet nozzle as recited in claim 14, wherein said tapers are uniform from said center portion to said edge portions.

* * * * *